United States Patent [19]

Ohashi

[11] 4,313,041

[45] Jan. 26, 1982

[54] SMALL SWITCH

[76] Inventor: Shigeo Ohashi, 5-20 Okusawa 1-chome, Setagaya-ku, Tokyo, Japan

[21] Appl. No.: 104,238

[22] Filed: Dec. 17, 1979

[30] Foreign Application Priority Data

Dec. 25, 1978 [JP] Japan ..... 53-175930[U]
Sep. 27, 1979 [JP] Japan ..... 54-132613[U]

[51] Int. Cl.[3] ..... H01H 21/02

[52] U.S. Cl. ..... 200/6 R; 200/5 R; 200/17 R; 200/307

[58] Field of Search ..... 200/6, 14, 7, 17 R, 200/18, 303, 307, 339, 67 G

[56] References Cited

U.S. PATENT DOCUMENTS

| | | | |
|---|---|---|---|
| 2,968,703 | 1/1961 | Meyer et al. | 200/6 BB |
| 3,821,503 | 6/1974 | Homan et al. | 200/38 B X |
| 3,883,706 | 5/1975 | Glaser | 200/303 X |
| 3,958,087 | 5/1976 | Mol et al. | 200/307 X |
| 3,993,881 | 11/1976 | Morsilio | 200/339 X |
| 4,133,990 | 1/1979 | Warner et al. | 200/307 X |
| 4,224,484 | 9/1980 | Haas et al. | 200/307 X |

*Primary Examiner*—James R. Scott
*Attorney, Agent, or Firm*—Lawrence I. Field

[57] ABSTRACT

A small switch comprising a plurality of switching elements with a hole which are oscillatably disposed one in each switch body and a single switching rod inserted through the holes of the switching elements whereby the contacts in a plurality of small switches can be made or broken simultaneously by operating the switching rod from the outside of the electronic device containing the switches. This small switch has projections and recesses on both sides of the switch body where the holes are formed so that a plurality of switches can be connected in series by fitting the projections of one switch into the recesses of other switch.

13 Claims, 15 Drawing Figures

SMALL SWITCH

BACKGROUND OF THE INVENTION

This invention relates to a small switch and more particularly to a small switch for use with printed circuit boards.

In recent years, a number of small switches generally called a dip switch are used on printed circuit boards in automatic vending machines and computers. Normally, these small switches cannot be operated from outside the device since the printed circuit boards on which the switches are mounted are contained within the casing. Thus, when for example the price of the goods stocked in the vending machine is altered and the mechanism for issuing the change must be adjusted, the outer casing must be removed to operate the switch. Furthermore, since the conventional switches are required to be operated one by one, an operator must waste time in operating a large number of switches. It is a recent trend that the demand for such semi-stationary switches is steadily increasing.

Depending on the electric circuitry on which the switches are used, there may be a case where a plurality of switches must be operated simultaneously. However, it is very difficult for the conventional dip switches to meet that purpose since they are so designed as to be operated individually.

When a number of switches are arranged in series, it is important that all the switches be set on a straight line as if they form a single switch for multiple circuits.

SUMMARY OF THE INVENTION

An object of this invention is to provide a new small switch which overcomes various drawbacks accompanying the conventional switches and which enables a number of switches to be operated simultaneously and accurately from outside the device without removing the outer casing of the device.

Another object of this invention is to provide a new small switch which makes it easy to design the switching circuit on the printed circuit board.

A further object of this invention is to provide a new small switch which satisfies the requirement that a plurality of switches be arranged in a straight line.

These and other objects of this invention can be achieved by a small switch which comprises: a cover or switch body having holes on both sides thereof; a switching element oscillatably supported in the switch body and having a hole extending therethrough at a location corresponding to the holes of the body; and a switching rod inserted through these holes of the switch body and the switching element so that the switch can be operated by rotating the switching rod.

This invention also presents a small switch which comprises: a switching element or knob having holes on both sides thereof facing in the direction perpendicular to that in which the switching element or knob is operated; a switch body having holes formed on both sides thereof at a location corresponding to the holes of the switching element or knob; projections formed on one of the sides of the switch body where the holes are formed; and recesses formed on the other side of the switch body; whereby a plurality of switches are connected in series by fitting the projections of one switch into the recesses of other switches and the contacts of the plurality of switches are simultaneously made or broken by rotating or tilting a single switching element or knob.

DESCRIPTION OF THE PREFERRED EMBODIMENT

The present invention will now be described with reference to the accompanying drawings showing preferred embodiments.

Figure 1:
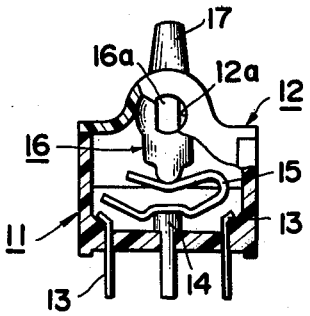
FIG. 1 is a cross-sectional view showing a small switch of the first embodiment of this invention.
Figure 3:
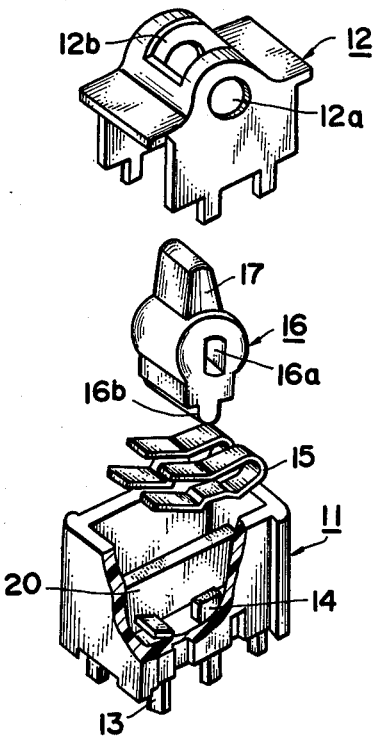
FIG. 3 is a perspective view of the first embodiment with components disassembled.
Figure 2:
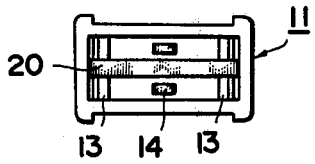
FIG. 2 is a plan view of the first embodiment with a cover, a switching element and a movable contact removed.

In FIGS. 1, 2 and 3 showing the first embodiment, reference numeral 11 represents a switch body which has a cover 12 placed on the upper portion thereof and also has stationary contacts 13 and a movable contact support 14 both embedded in the bottom portion thereof and whose lower ends form printed circuit board insertion terminals. Mounted at its downwardly-facing recessed portion on the movable contact support 14 is an elastic movable contact 15 of a shape illustrated in the figure made of a spring material such as phosphor bronze or beryllium bronze. Between the upper surface of the movable contact 15 and the cover 12 is disposed a switching element 16 which is tilted to the right and left to move the movable contact 15 thereby performing the switching action between the stationary contacts 13 and the support 14.

The cover has holes 12*a* formed at the lower sides thereof through which a switching rod 18 (refer to FIG. 6) is inserted, and also has a hole 12*b* formed on its top portion through which a knob 17 formed on the upper portion of the switching element 16 is inserted. These holes 12*a* oppose each other in the direction perpendicular to that in which the switching element is operated, as shown in FIG. 3. The switching element 16 has a hole 16*a* extending therethrough at a location corresponding to the hole 12*a* of the cover 12 to receive the switching rod 18. In this embodiment, the cross section of the hole 16*a* is substantially rectangular, the same as that of the switching rod 18. It is apparent, however, that the hole 16*a* may have any other form of cross section, such as square, star and cross, as long as the switching rod 18 tightly fits into the switching element 16. The switching element 16 has formed on the lower portion thereof a sliding portion 16*b* adapted to slide on the upper portion of the elastic movable contact 15. The switching rod 18 may either be secured to or detachably inserted into the switching element 16. In a case where the rod 18 is secured to the switching element 16, the rod 18 may be formed at one portion with a groove 18*a* into which a C-ring 19 is installed so as to prevent the rod 18 from coming off the element 16. It is also possible to detachably mount the knob 17 to the switching element 16. In this embodiment shown, the holes 12*a* are formed on the cover 12, but in certain constructions of the switch the holes may have to be formed in the switch body. Reference numeral 20 indicates an insulation wall, 21 a printed circuit board, and 22 holes into which terminals of the switch are inserted.

Figure 4:
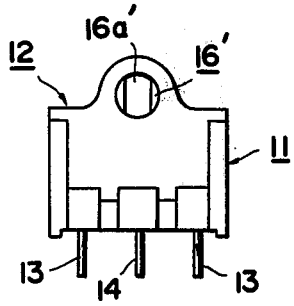
FIG. 4 is a side view of the first embodiment with some modifications of the switching element and movable contact.
Figure 5:
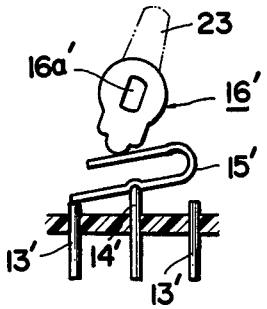
FIG. 5 is a schematic view showing internal construction of the modified embodiment as illustrated in FIG. 4.

In FIGS. 4 and 5 showing the modification of the first embodiment, a switching element 16' has the same construction as that of the switching element 16 except that the modified switching element 16' does not have a knob 17. Numeral 13' represents a stationary contact, 14' a movable contact support, and 15' a movable contact. These components have functions similar to those of the preceding components 13, 14, 15 but with slightly different forms. Since in this embodiment the switching element 16' does not have a knob 17, it is not necessary to form a hole 12*b* on the cover 12. Numeral 23 is a lever. If this lever 23 is fitted on the rod inserted through the hole 16*a'* of the switching element 16', an ordinary lever switch is obtained. The use of a wave-shaped knob or a panel knob instead of the lever 23 will result in a wave-shaped switch and a rotary switch, respectively.

Figure 6:
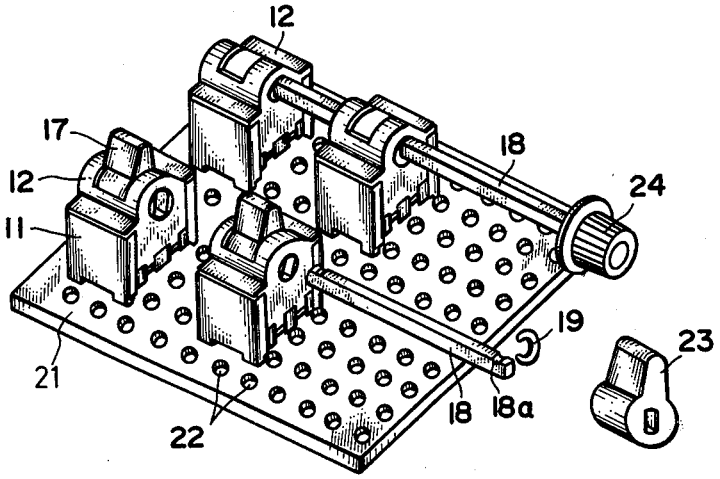
FIG. 6 is a perspective view of the first embodiment mounted on a printed circuit board.

Using the first embodiment of this invention having the above-mentioned construction, it is possible to obtain a rotary switch for use in printed circuit boards in which, in addition to the individual switching action performed by the knob 17 or lever 23, a plurality of switches can be operated simultaneously, by inserting the common rod 18 through the holes 16*a* or 16*a'* of a plurality of switching elements (two switching elements shown in FIG. 6) and fitting a knob 24 to the end of the rod 18, as shown in FIG. 6. Thus, all the conventional drawbacks mentioned earlier are solved by this invention which enables a number of switches to be operated simultaneously, quickly and accurately by the switching rod 18 from outside without removing the outer switch box.

If the switch is constructed such that the switching rod 18 is detachably inserted through the switching elements, the rod can be removed from the switching device after the switching operation has been performed. This greatly contributes to easier maintenance and transportation of the switch device. Furthermore, by making use of the switching element 16 with a knob 17 or lever 23, it is possible without using the rod 18 to operate the switch.

According to the foregoing embodiment of this invention, a plurality of switches can be arranged on a single rod to form a rotary type multi-pole switch by which the contacts of a desired number of circuits can be made or broken. In this case, the switches can be spaced from one another at desired intervals. If the conventional dip switches are used to simultaneously open or close a plurality of circuits on the printed circuit board with spacings therebetween, the switching circuitry on the printed circuit board becomes complicated and is difficult to design in contrast with the circuitry constructed of lead wiring since the dip switches must be arranged close together. However, the switches of this invention can be placed apart from each other on appropriate points on the circuits required to be opened or closed simultaneously so that the designing of circuitry on the printed circuit board becomes very easy.

The switch according to this invention employs the movable spring contact 15 of the shape illustrated in the Figures and the switching element 16 having sliding portion 16*b* formed integral therewith. Thus, it is not necessary to provide a sliding element and a spring, which are required in conventional switches, for actuating the movable contact with an ear at the central portion to tilt to the right and left. Therefore, the structure becomes simpler and the height of the switch smaller. Furthermore, since the present switch does not require the ear for mounting the central portion of the conventional movable contact on the support, the displacement angle of the movable contact can be made smaller, resulting in smaller size of the switch.

Moreover, by making the knob detachable from the switching element, the switch of the preceding embodiment can be used as various types of switches, such as a lever switch, wave-shaped switch and rotary switch, thus providing very wide applications. Therefore, it can easily be standardized, which in turn reduces the cost. The amount of inventory can also be reduced. Because of these features and simple construction, the switch of this invention for use with the printed circuit board is expected to become a promising product in the near future.

Figure 7:
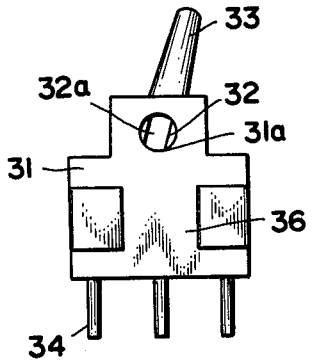
FIG. 7 is a front view showing a small switch of the second embodiment of this invention.
Figure 8:
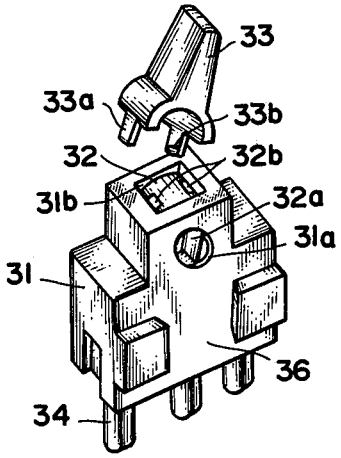
FIG. 8 is a partially disassembled perspective view of the second embodiment.
Figure 9:
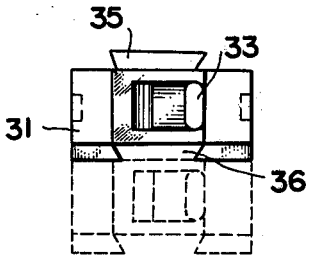
FIG. 9 is a plan view of the second embodiment.

Referring to FIGS. 7, 8 and 9 showing the second embodiment of this invention, reference numeral 31 represents a switch body which has holes 31*a* formed on both sides thereof facing in the direction perpendicular to that in which the switch is operated, and also has a hole 31*b* on the upper portion thereof. The holes 31*a* are for receiving the switching rod to be described later and the hole 31*b* for receiving a knob 33 to be mounted to the switching element 32. The switching element 32 has a hole 32*a* extending therethrough at a portion corresponding to the hole 31*a* on the body for receiving the switching rod, and also has recesses 32*b* formed on the upper portion thereof, into which legs 33*a* of the knob 33 are fitted. Thus, the knob 33 mounted on the switching element is tilted to the right and left to actuate a movable contact (not shown) contacting the lower portion of the switching element 32 thereby performing switching operation. Numeral 33*b* is a projection formed to ensure the knob 33 to be tightly fitted into the switching element. While in this embodiment knob 33 is formed into a shape of paddle or lever, it can also be formed into other shapes such as a wave form. Numeral 34 indicates terminals.

Figure 10:
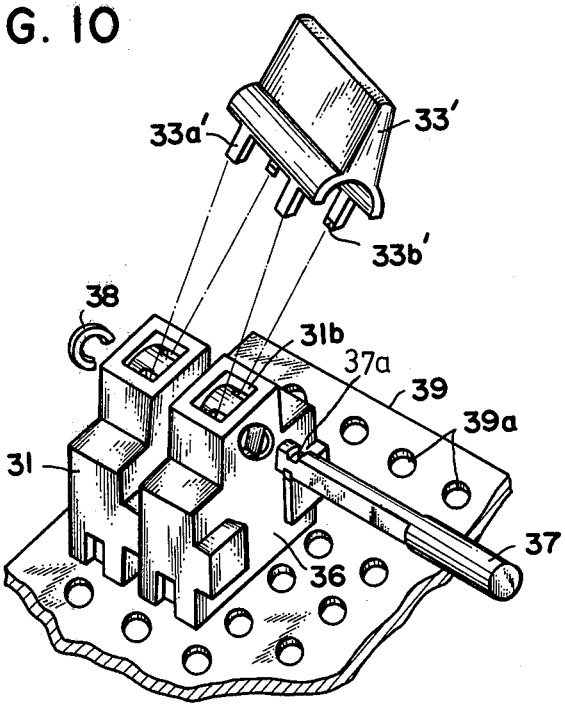
FIG. 10 is a perspective view of the second embodiment with a modified knob mounted on a printed circuit board.

The switch body 31 has a projection 35 formed on one side and a recess 36 formed on the other side, the both sides facing each other in the direction virtually perpendicular to that of the switching operation. The projection 35 and the recess 36 of the switch body 31 may be fitted into the recess and the projection of other switch bodies, respectively, so that a plurality of switch bodies 31 are connected in parallel as shown in FIGS. 9 and 10 (the condition of this connection is called a "longitudinal connection" in this invention). FIG. 10 is a perspective view showing two switch bodies in longitudinal connection mounted on the printed circuit board 39. Numeral 37 denotes a switching rod which is inserted through the holes 31*a* of the switch body and a hole 32*a* of the switching element 32. 38 is a C-ring installed into the recess 37*a* of the switching rod 37. By inserting the switching rod 37 through a plurality of switches, the switch device of this invention can be used as a rotary switch. Furthermore, if the knob 33 or 33' is mounted to the switching element, the switch can be used as a paddle switch. A knob 33' shown in FIG. 10 is for multiple switching and enables a plurality of switches to be actuated simultaneously by a single operation. FIG. 10 shows an example of two switches in longitudinal connection, but it is apparent that this method of connection can also be applied to three or more switches.

As a modified construction for connecting the switching element 32 and the knob 33, it is also possible to form a projection on the top of the switching element and a recess on the underside of the knob for receiving the projection.

While in the second embodiment, the switching element and the knob are detachably connected, they may be formed integral with each other.

Figure 11:
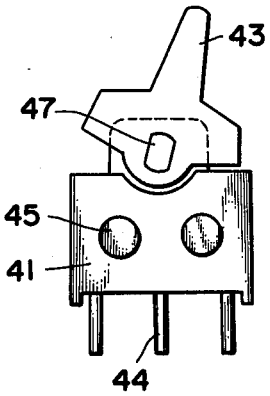
FIG. 11 is a front view of the modified second embodiment.
Figure 12:
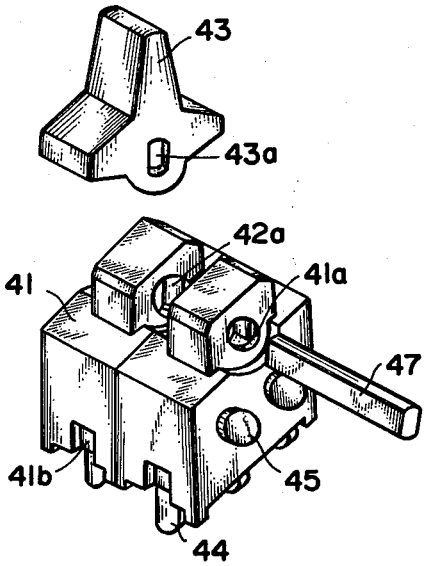
FIG. 12 is a perspective view showing the modified second embodiment of FIG. 11 in a disassembled state.
Figure 13:
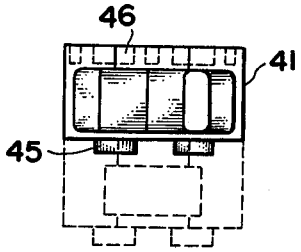
FIG. 13 is a plan view of the modified second embodiment of FIG. 11.

FIGS. 11, 12 and 13 are a front view, a perspective view and a plan view, respectively, showing a modified construction of the second embodiment of this invention. In these figures, reference numeral 41 indicates a switch body, 43 a knob and 44 terminals. The switch body 41 has a hole 41*a* extending therethrough, perpendicular to the direction of the switching operation to receive the switching rod 47. The switching element has a hole 42*a* extending through its sides at a point corresponding to the hole 41*a* of the body 41 to receive the switching rod 47. The knob 43 is formed with holes 43*a* on both sides at locations corresponding to the hole 42*a*. The rod 47 is inserted through the hole 43*a*.

The switch body 41 also has projections 45 formed on one of those sides that face each other in the direction perpendicular to that of the switching operation, i.e., the sides on which the holes 41*a* are formed, and recesses 46 formed on the other side. In longitudinally connecting a plurality of switches, the projections 45 and the recesses 46 are fitted into the recesses and projections, respectively, of other switches. In this embodiment, two projections or two recesses are formed on each side. However, a pair of projection and recess may be formed on each side so that the both sides are identical. This is very advantageous in the manufacturing process. Square projections and recesses may of course be used instead of circular ones.

This embodiment has no hole on the top of the body through which the knob is inserted and mounted on the switching element, but rather has the knob fitted over the top of the body.

Figure 14:
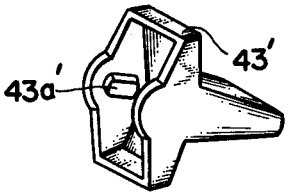
FIG. 14 is a perspective view showing another example of a knob.

FIG. 14 is a perspective view showing another example of a knob. Unlike the knob illustrated in FIG. 12, the knob 43' shown in FIG. 14 is not provided with a hole but is formed with projections 43*a'* on the inner side surfaces which fit into the holes 42*a* of the switching element. When a single switch is used independently, the knob 43 may be mounted over the top of the switch body 41 and then the switching rod 47 is inserted; or a stepped shaft of a length about the width of the switch may be inserted into the hole 42*a* of the switching element, instead of the rod 47, and then the knob 43 is mounted over the top of the switch body. It is also possible to secure the knob to the switching element by fitting the projections 43*a'* shown in FIG. 14 into the hole 42*a* of the switching element. The knob shown in FIG. 14 is for use with a single switch, but it is possible to extend the width of the switch, as in FIG. 10, to make it applicable to a plurality of switches.

Figure 15:
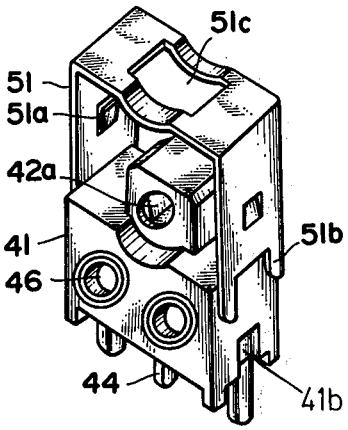
FIG. 15 is a perspective view showing a bracket for reinforcing the switch.

FIG. 15 is a perspective view of a bracket used to firmly secure the switch to the printed circuit board. In mounting the switch on the printed circuit board, the bracket 51 is fitted over the switch body 41 so that the tongue 51*a* formed on the inner side surface of the bracket fits into the recess 41*b* on the switch body 41 thereby firmly securing the bracket 51 on the switch body 41. Then, the legs 51*b* of the bracket 51 are inserted into the holes 39*a* of the printed circuit board 39 (refer to FIG. 10) and the lower ends of the legs 51*b* are soldered to the printed circuit board. In this way, the use of the bracket enables the switch to be firmly mounted.

Since the small switch of the second embodiment of this invention has the construction described above, a plurality of small switches can be connected in series in good order on the printed circuit board by fitting the projections into the recesses of the switch bodies to be connected. Thus, according to the second embodiment, a multiple circuit switch such as a double-circuit switch, triple-circuit switch, four-circuit switch or the like can readily be obtained by connecting a plurality of single-circuit switches. Thus, there is no need for providing special switches for double-circuit, triple-circuit, four-circuit or the like. That is, the multiple circuit switch may be fabricated by the provision of any fundamental single-circuit switch.

Furthermore, if the switching rod is inserted into the holes of the switch body and the switching element, the switch can be used as a rotary switch. Similarly, by employing various kinds of knobs such as a paddle type, lever type and wave-shape type, the switch of this invention can be used as a paddle, lever, or wave-shape switch.

Though preferred embodiments of the invention have been shown and described in the above, it should be noted that many changes and modifications may be made therein without departing from the spirit of the invention and the scope of the appended claims.

What is claimed is:

1. A small switch which may be used selectively as either a lever switch or as a rotary switch, comprising:

a switch housing having a pair of side faces which has a first and a second hole formed respectively on each of said side faces which face each other in the direction virtually perpendicular to that of the switching operation through which first and second holes a switching rod may be inserted, and a third hole formed at the top portion of said housing through which a knob operatively connected to the upper portion of a switching element is projected outwardly;

a main contact in said housing and consisting of stationary contacts;

a movable contact-support and a movable contact rockably mounted on said movable contact-support being embedded in the bottom portion of said housing;

and a switching element disposed on said movable contact for actuating the same, said switching element having a fourth hole extending therethrough at a location corresponding to said first and second holes formed on said switch housing to receive said switching rod;

whereby said switch may be operated by one of said knob and said switching rod selectively to make or break contacts in the switch.

2. A small switch as set forth in claim 1, wherein said knob is detachably mounted on said switching element.

3. A small switch as set forth in claim 1 or 2, including a switching rod inserted through the holes of the body and the switching element so that the contacts of the switch can be made or broken by selectively operating the switching rod or the knob.

4. A small switch as set forth in claim 3, wherein the switching rod is inserted through the holes of a plurality of switching elements so that by operating the switching rod or the knob the contacts of a plurality of switches can be made or broken simultaneously.

5. A small switch as set forth in claim 3, wherein the switching rod is detachably inserted through the holes of the switching elements.

6. A small switch as set forth in claim 4, wherein the switching rod is detachably inserted through the holes of the switching elements.

7. A small switch as set forth in claim 3, wherein the cross section of the hole of the switching element and the cross section of the switching rod are of square, rectangular or star-like configuration.

8. A small switch which may be used selectively as either a lever switch or as a rotary switch, comprising:

a switch housing having holes formed on both sides thereof which face each other in the direction virtually perpendicular to that of the switching operation;

a main contact in said housing and consisting of stationary contacts;

a movable contact-support and a movable contact rockably mounted on said movable contact-support being embedded in the bottom portion of said housing;

a switch element disposed on said movable contact for actuating the same and a hole extending through both sides thereof at a location corresponding to said pair of first and second holes, into which a switching rod may be operatively received;

the switch housing also having projections formed on one of the sides thereof and adapted to fit into the recesses of a second switch housing and also recesses formed on the other side and adapted to receive the projection of a third switch housing;

and a switching rod inserted through the holes of the switch housing and the switching element;

whereby a plurality of switches are connected in series by inserting the projections into the recesses.

9. A small switch as set forth in claim 8, wherein the switching rod is detachably inserted through the hole of the switching element.

10. A small switch as set forth in claim 8, wherein the knob is mounted to the switching elements so that the contacts of a plurality of switches can be made or broken simultaneously by operating the single knob.

11. A small switch as set forth in claim 8, wherein the knob is provided at its inner side surfaces with projections instead of holes, and the projections are fitted into the hole of the switching element so that the contacts of the switch can be made or broken by operating the knob.

12. A small switch as set forth in claim 8, wherein the switching element and the knob are formed integral.

13. A small switch as set forth in claim 8, wherein a projection and a recess are formed on each side of the switch body.

* * * * *